United States Patent [19]

Arce

[11] 4,121,530

[45] Oct. 24, 1978

[54] MAST BASE HINGE FOR A SAILBOAT

[75] Inventor: Henry Leyva Arce, San Juan Capistrano, Calif.

[73] Assignee: Coast Catamaran Corp., Irvine, Calif.

[21] Appl. No.: 805,809

[22] Filed: Jun. 13, 1977

[51] Int. Cl.[2] ..... B63B 15/00

[52] U.S. Cl. ..... 114/91

[58] Field of Search ..... 114/39, 90, 91–94, 114/98; 52/116, 121, 146, 700; 248/514

[56] References Cited

U.S. PATENT DOCUMENTS

| | | | |
|---|---|---|---|
| 145,648 | 12/1873 | Hammond | 114/91 |
| 2,985,261 | 5/1961 | Kubesch | 248/514 |
| 3,099,976 | 8/1963 | Schwaneke et al. | 114/91 |
| 3,507,240 | 4/1970 | Butler | 114/91 |
| 3,898,948 | 8/1975 | Huff | 114/91 |

*Primary Examiner*—Trygve M. Blix
*Assistant Examiner*—Jesus D. Sotleo

[57] ABSTRACT

The mast of a sailboat is provided with a base casting rigidly secured to the bottom of the mast. A hinge member in the form of a socket is pivotally mounted to the rear of the mast base casting. The socket is adapted to fit over a rounded bearing pad of low friction material mounted to the top of a mast step which is secured to the hull or to a cross bar in the case of a catamaran. The hinge member and mast step are provided with transverse bores. When the mast is in a lowered position, the hinge member is swung forwardly from the mast base and over the bearing pad until the transverse bores are aligned. A pin is placed in the aligned bores to temporarily couple the hinge member to the mast step so that the mast can be raised and secured while the hinge member and mast step are coupled together. After the mast is secured, the pin is removed from the bores to permit the mast to rotate and to rake freely under operating conditions.

9 Claims, 3 Drawing Figures

MAST BASE HINGE FOR A SAILBOAT

BACKGROUND AND SUMMARY

The present invention relates to apparatus for mounting the base of a mast of a sailboat in such a manner that the mast can easily, quickly and safely be raised. Although the invention has general application to sailboats, it will be disclosed, in its preferred form, in a catamaran sailboat.

In most sailboats of a size sufficient to carry more than one person, except for the very largest boats, the mast is removable for convenience of storage and transportation. Further, when the mast is mounted, it is desirable that it be permitted to rotate as the tack of the sail is changed, and to rake (that is, become inclined relative to a perpendicular to the horizontal) under the various conditions of operation. Rotation of the mast reduces wind resistance if the mast is oblong or tear-shaped in horizontal cross section, and it also permits the luff of the mainsail to assume the best operating position. Raking of the mast permits the boat to be balanced—that is, alter the helm of the boat. Sailboats have long been known which permit both raking and rotation of the mast.

Apparatus is also known for permitting the mast to be removed or to be raised. One such apparatus is shown in U.S. Pat. No. 3,507,240. This structure does not, however, permit any substantial rotation of the mast once it is raised, nor does it permit forward raking of the mast. In one prior construction of the assignee of the present invention the bottom of the mast was provided with a ball shape and a hook. The hook engaged a pin on the rear of the mast step, which had a cup shape. To raise the mast, the hook was engaged and the mast was then raised upwardly until the base of the mast was received in the cup on the mast step.

According to the present invention, the mast is provided with a base casting secured to the bottom of the mast. A hinge member in the form of a socket is pivotally mounted to the mast base casting. The socket is adapted to fit over a rounded bearing pad of low friction material mounted to the top of a mast step. The mast step is mounted to a forward cross bar which is part of a frame connecting the two hulls of the catamaran together.

The hinge and mast step are provided with transverse bores which are aligned when the hinge member is assembled to the mast step with the mast lowered (i.e., extending aft of the mast step). In other words, with the mast lowered and extending rearwardly, the hinge member is rotated forwardly from a first position in which it engages the mast base to a second position in which the socket portion of the hinge member is coupled over the bearing pad. The bearing surfaces of the hinge member and mast step are preferably spherical. A pin is then placed in the aligned bores of the hinge member and mast step to temporarily secure the hinge member to the mast step so that the mast may be rotated upwardly and secured by shrouds and a forestay.

After the mast is secured, the pin is removed to permit the mast to rotate and to rake freely under operating conditions.

Thus, the present invention provides a simple yet safe and convenient apparatus for quickly and reliably raising the mast while permitting the mast to rotate and rake freely after it is raised. It will be appreciated that the mast base cannot free itself from the mast step during the raising operation as long as the pin is engaged, and this is considered an important feature of the present invention because if the mast slips and falls during the raising operation, it could become damaged and thereby require replacement. The mast may be lowered by reversing the steps.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
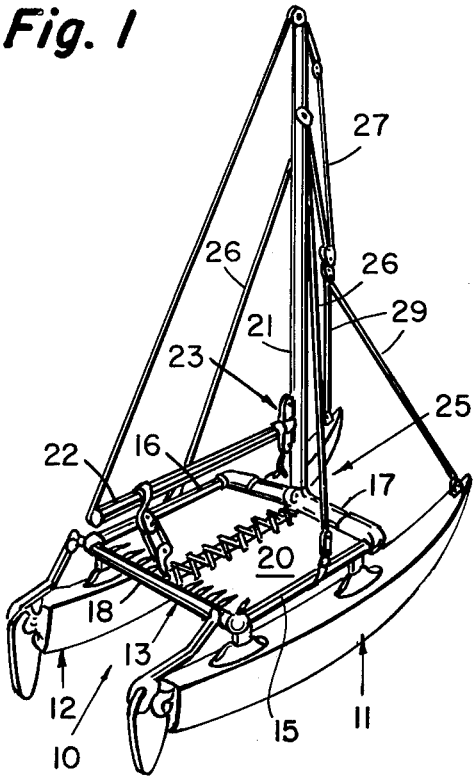
FIG. 1 is an upper rear perspective view of a catamaran sailboat incorporating the present invention.

Referring first to FIG. 1, there is shown a catamaran sailboat generally designated by reference numeral 10. The sailboat 10 has two elongated hulls 11 and 12 which are maintained in spaced relation by a rigid metal frame structure 13 preferably made of hollow aluminum tubes.

The frame 13 includes two side frame members 15 and 16 which extend longitudinally of the hulls 11, 12 respectively. The side frame members 15, 16 are joined together by a forward cross bar 17 and a rear cross bar 18. The frame 13 not only joins the hulls together, but provides support for flexible deck or trampoline, generally designated 20. The frame 13 also provides a base for mounting a mast 21 to which a boom 22 is pivotally mounted at 23 in a conventional manner. The mast 21 is removably attached to the forward cross bar 17 by means of a mast base hinge assembly generally designated 25 and which is the subject of the present invention. In the raised position, the mast is supported by a pair of shrouds 26 and a forestay 27, the bottom of the forestay being secured to the forward tips of the hulls by means of bridle wires 29.

The mast 21 has a cross sectional shape in the form of a teardrop—that is, it is wider at the forward portion and tapers to a narrow rear edge, at which there is formed a vertical track 30 (see FIG. 2) for receiving a bolt rope located at the luff of the mainsail. The mast 21 is a hollow aluminum tube. A base casting 31 is rigidly secured to the bottom of the mast; and it includes a recessed portion 33 conforming to the shape of the mast 21 and received in its bottom. The base casting 31 includes a lip portion 34 for abutting the bottom edge of the tubular mast 21, and a rearwardly extending flange 35 on which a pulley 36 is mounted and used for routing the bottom of the halyard line.

Inside the recessed portion 33 of the base casting 31 and extending forwardly of the rearmost portion is an upright flange 38, to the bottom of which there is pivotally mounted at 39 a hinge member generally designated 40. The hinge member 40 includes a socket portion 41 at the bottom of which there is a skirt or rim 42 which extends beneath the lip 34 of the mast base 31. The forward portion of the rim 42 is recessed at 43 to receive an extension 44 of the mast base 31. Thus, when the mast is fully raised, the lip 34 of the base 31 rests on the rim 42 of the hinge member for support, and the extension 44 of the mast base is received in the recess 43 of the hinge so that the two are coupled together and will rotate as one.

The socket 41 of the hinge member 40 is received on a spherical bearing pad 45 of low friction material such as nylon or equivalent. The bearing pad 45 is, in turn, mounted to a mast step 48 which is secured to the top of the forward cross bar 17. The cross bar 17 also has a teardrop shape, but the narrower portion faces forwardly and defines a track 50 in which a lug rides for controlling a jib sail, if one is used.

The center portion of the forward cross bar 17 is supported by an upright post 51 which extends through the cross bar 17 and is received in a bore 52 at the base of the mast step. The step is provided with forward and rear flanges 53, 54 which are secured to the upper portion of the cross bar 17 by means of rivets 55. A line 56 defines the axis of the post 51 and also the axis of rotation of the mast 21. The mast step is provided with a transverse bore 59 located rearwardly of the vertical axis of rotation 56, and the rim 42 of the hinge member 40 is provided with similar bores which align with the bore 59 when the hinge member is rotated forwardly and placed on the mast step.

The bearing pad 45 provides a bearing surface conforming to a portion of a sphere, to permit turning and raking of the mast. The top of the pad is recessed at 60 to receive a bushing 61, a washer 62 and a threaded fastener 63 which secures the bearing pad to the mast step which, in turn, is rigidly secured to the cross bar.

When the bores in the mast step and the hinge member are aligned, a pin 65 may be inserted into the aligned bores to temporarily couple the hinge member to the mast step, as will be described presently. The location of the bores in the hinge member and mast step are beneath the bottom of the mast when the mast is raised (FIG. 2) to facilitate withdrawal of the pin after the mast is raised.

Figure 3:
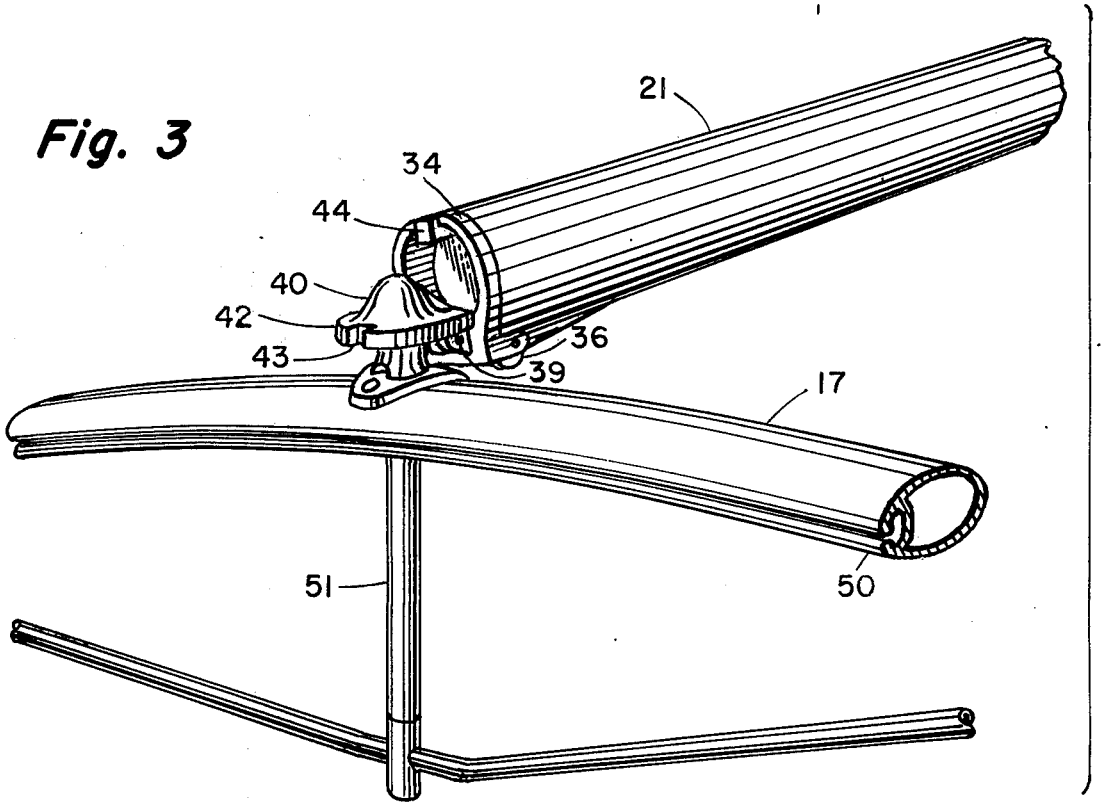
FIG. 3 is a perspective view taken from the left front showing the mast in a lowered position.

It will be observed that when the mast is lowered as in FIG. 3, the hinge member 40 may be rotated about pin 39 between a first position in which the hinge member engages the mast base and a second position in which the hinge member, but not the mast base, is assembled to the mast step.

RAISING AND REMOVING THE MAST

Figure 2:
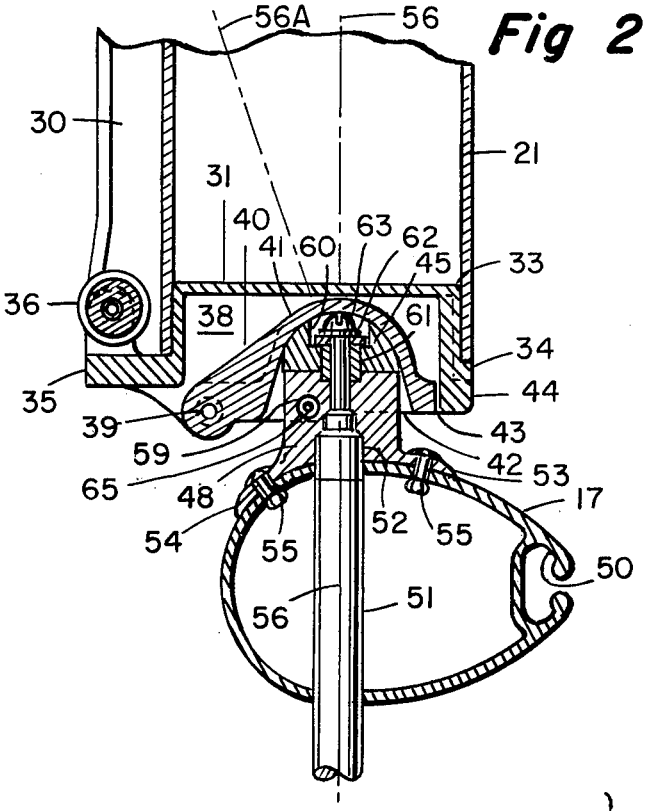
FIG. 2 is a fragmentary vertical transverse cross sectional view taken through the base of the mast parallel to the direction of travel of the boat and transverse to the forward cross bar.

To raise the mast, with the mast in a generally horizontal position extending aft of the forward cross bar 17, as illustrated in FIG. 3, the hinge member 40 is rotated to the second position and assembled to the mast step 48 with the socket portion 41 of the hinge member resting on the bearing pad 45. With the bore 59 in the mast base aligned with the corresponding bore in the hinge member 40, the pin 65 is inserted as seen in FIG. 2. This secures the hinge member 40 to the mast step.

The mast 21 may then be raised by rotating the mast base 31 about the pin 39 to the raised portion until the shrouds 26 begin to tension. At this time, the forestay 27 is tightened, and the mast will remain in place. The pin 59 is then removed, and the mast is free to rotate about the axis 56, and it is also free to rake, the maximum rake position being denoted by the line 56A in FIG. 2 as representative of the angle to which the axis 56 could incline under operating conditions.

To lower the mast, the pin 59 is again inserted and the steps described above are simply reversed.

Having thus disclosed in detail a preferred embodiment of the invention, persons skilled in the art will be able to modify certain of the structure which has been illustrated and to substitute equivalent elements for those shown while continuing to practice the principle of the invention; and it is, therefore, intended that all such modifications and substitutions be covered as they are embraced within the spirit and scope of the appended claims.

I claim:

1. Apparatus for removably mounting the mast of a sailboat comprising: a hinge member pivotally mounted to the bottom of said mast and rotatable between a first position in which said hinge member engages the bottom of said mast and a second position in which said hinge member is spaced from the bottom of said mast; a mast step rigidly mounted to said sailboat; and coupling means for removably coupling said hinge member to said mast step, whereby when said hinge member and mast step are coupled together, said mast may be raised while coupled to said hinge member, said hinge member and said mast step defining complementary bearing surfaces, at least a portion of said bearing surfaces being smoothly curved, whereby said mast may rotate and rake relative to said mast step when said mast is raised.

2. The apparatus of claim 1 wherein said hinge member defines a socket to provide one of said bearing surfaces, said socket being generally spherical at least over a portion thereof, and wherein said mast step includes a low friction bearing pad, at least a portion of which is spherical and complementary to the bearing surface of said hinge member.

3. Apparatus for removably mounting an elongated mast of a sailboat comprising: a base member rigidly secured to the bottom of said mast; a hinge member; means for pivotally connecting said hinge member to said base member for pivotal motion about an axis transverse of the direction of elongation of said mast between a first position in which said hinge member is coupled to said base member and a second position in which said hinge member is spaced from said base member; a mast step rigidly mounted to said sailboat; said hinge member and mast step defining complementary bearing surfaces permitting said mast to rotate and to rake when said mast is raised and each further defining a bore adapted to receive a pin, said bores being arranged to align with each other when said hinge member is assembled to said mast step with said mast lowered and extending aft of said step; and a pin adapted to be placed in said aligned bores of said hinge member and mast step when said hinge member is pivoted to said second position; whereby said mast may be raised while said pin couples said hinge member to said mast step, and said mast is free to rotate or to rake after it is raised and said pin is removed.

4. The apparatus of claim 3 wherein said hinge member defines a socket for providing one of said bearing surfaces and said mast step includes a bearing pad at the top thereof, at least a portion of which is generally spherical and conforming to the shape of the bearing surface of said socket.

5. The apparatus of claim 4 wherein said hinge member is pivotally mounted to said base member at a location spaced rearward of an extension of the axis of said mast, whereby said mast may be rotated rearwardly of said mast step to lower the mast.

6. The apparatus of claim 3 wherein said base member includes a recessed portion received in the bottom of said mast and including a lip engaging and abutting the lower edge of said mast, said hinge member further including a rim for engaging the lip of said base member, whereby the lip of said base member bears against the rim of said hinge member when said mast is raised.

7. The apparatus of claim 3 wherein one of the lip of said base member and the rim of said hinge member is slotted and the other defines an extension for fitting into said slot when said mast is raised and said hinge member is in said first position relative to said base member, whereby when said mast is rotated, said hinge member will also rotate.

8. The apparatus of claim 7 wherein said aligned bores are located beneath the bottom of said mast in the raised position.

9. Apparatus for removably mounting the mast of a catamaran sailboat which includes a forward cross bar extending between a hull comprising a hinge member pivotally mounted to the bottom of said mast and rotatable between a first position in which said hinge member engages the bottom of said mast and a second position in which said hinge member is spaced from the bottom of said mast, a mast step rigidly mounted to said sailboat, and coupling means for removably coupling said hinge member to said mast step, whereby when said hinge member and mast step are coupled together, said mast may be raised while coupled to said hinge member, said mast step being rigidly mounted to said forward cross bar and including a bearing pad, at least a portion of which is generally spherical and adapted to engage a corresponding surface of said hinge member.

* * * * *